US006694572B2

(12) United States Patent
Cherif et al.

(10) Patent No.: US 6,694,572 B2
(45) Date of Patent: Feb. 24, 2004

(54) SLIVER CHANNEL WITH REDUCED FRICTION

(75) Inventors: Chokri Cherif, Ingolstadt (DE); Burkhard Wulfhorst, Stolberg (DE)

(73) Assignee: Trützschler GmbH & Co., KG, Mönchengladbach (DE)

( * ) Notice: Subject to any disclaimer, the term of this patent is extended or adjusted under 35 U.S.C. 154(b) by 0 days.

(21) Appl. No.: 10/270,317

(22) Filed: Oct. 15, 2002

(65) Prior Publication Data

US 2003/0226241 A1 Dec. 11, 2003

Related U.S. Application Data

(63) Continuation of application No. 10/165,791, filed on Jun. 10, 2002.

(51) Int. Cl.[7] ..... D04H 11/00

(52) U.S. Cl. ..... 19/159 R; 19/150; 19/157

(58) Field of Search ..... 19/159 R, 159 A, 19/150, 157, 65 A, 98, 236, 65 R, 105, 239; 28/289; 57/403; 100/82, 83, 84; 226/97.1, 97.2, 97.3, 97.4; 406/86

(56) References Cited

U.S. PATENT DOCUMENTS

| | | | | |
|---|---|---|---|---|
| 3,105,996 A | * | 10/1963 | Naegeli | 19/159 R |
| 3,977,045 A | | 8/1976 | Saurenman | |
| 4,267,620 A | * | 5/1981 | Allen, Jr. | 19/239 |
| 4,318,206 A | * | 3/1982 | Ferri et al. | 19/159 R |
| 4,905,352 A | * | 3/1990 | Gunkinger et al. | 19/159 R |
| 4,967,449 A | * | 11/1990 | Gasser | 19/159 R |
| 5,287,598 A | * | 2/1994 | Gunter et al. | 19/159 R |
| 5,317,786 A | * | 6/1994 | Oexler et al. | 19/159 R |

FOREIGN PATENT DOCUMENTS

| | | |
|---|---|---|
| DE | Nr. 1 925 736 | 10/1965 |
| DE | GM 75 10 100 | 6/1977 |
| DE | 28 14 382 A 1 | 10/1978 |
| DE | 27 21 422 A 1 | 11/1978 |
| DE | 28 49 101 A 1 | 5/1980 |
| DE | 41 31 134 A 1 | 6/1993 |

* cited by examiner

*Primary Examiner*—Gary L. Welch
(74) *Attorney, Agent, or Firm*—Venable LLP; Robert Kinberg; Stuart I. Smith

(57) ABSTRACT

A coiler plate is provided for sliver coil depositing. The coiler plate has a rotational axis, a spatially curved sliver channel having a wall, an inside wall surface, a sliver inlet, and a sliver outlet. The sliver inlet is arranged substantially coaxial with the rotational axis, and the sliver outlet is arranged at a radial distance and an axial distance from the sliver inlet. The device has a field producer that produces at least one of a magnetic field and an electric field. The field is for acting on the sliver such that the sliver is positioned away from at least a portion of the sliver channel inside wall surface.

14 Claims, 3 Drawing Sheets

SLIVER CHANNEL WITH REDUCED FRICTION

CROSS-REFERENCE TO RELATED APPLICATION

This application is a continuation of U.S. patent application Ser. No. 10/165,791, filed Jun. 10, 2002, the disclosure of which is incorporated herein by reference.

BACKGROUND OF THE INVENTION

The invention relates to a device for use with a sliver coiler. More particularly, the invention relates to a coiler plate for sliver coil deposits on, for example, draw frames, carding machines and the like. The coiler plate comprises a spatially curved sliver channel with a sliver inlet and a sliver outlet. The inlet is arranged next to, or coaxial with, the rotational axis and the outlet is arranged at a radial and axial distance from the inlet. The running sliver is subjected to a tensioning draft (force) and movement relative to the inside wall of the sliver channel. A frictional resistance exists between the sliver and the inside wall of the sliver channel.

In practical operations, the sliver in the sliver channel is subjected to multiple movement and force effects. The sliver experiences a certain slacking draft between withdrawing rollers, that pull the sliver after it is formed, and the moving can. A tensile force moves the sliver from the inlet, through the sliver channel, and to the outlet. The outlet is arranged at an axial distance to the inlet, thus causing the sliver to be additionally acted upon by a centrifugal force because of the rotational movement. This force results in a bulging of the sliver path and can lead to an undesirable draft. The centrifugal force is counteracted by reducing the distance between the curved sliver channel and the rotational axis, resulting in the inside wall exerting a counter force onto the sliver and reducing the bulging. The counter force, however, results in increased friction between the sliver material and the inside wall and reduces the sliver movement speed. Thus, undesirable drafts caused by friction cannot be ruled out.

A coiler plate design for delivery speeds of up to 1000 m/min with a curved sliver channel of polished stainless steel has been used. However, a permanent increase in the sliver speed above 1000 m/min was not possible with this design. High frictional forces between the inside wall and sensitive draw frame slivers, in particular, resulted in undesirable drafts.

SUMMARY OF THE INVENTION

Thus, it is an object of the invention to create a coiler plate of the aforementioned type, which avoids the previously mentioned disadvantages and, in particular, results in an improved sliver guidance and sliver quality.

Particular embodiments of the invention provide a coiler plate for sliver coil depositing. The coiler plate has a rotational axis, a spatially curved sliver channel having a wall, an inside wall surface, a sliver inlet, and a sliver outlet. The sliver inlet is arranged substantially coaxial with the rotational axis, and the sliver outlet is arranged at a radial distance and an axial distance from the sliver inlet. The device has a field producer that produces at least one of a magnetic field and an electric field. The field is for acting on the sliver such that the sliver is positioned away from at least a portion of the sliver channel inside wall surface.

The measures according to the invention take into account the effects of different movements and forces exerted by the sliver and onto the sliver on the inside of the sliver channel. The forces are not effective in the same way at all locations. As a result, undesirable or interfering forces can be countered partially and individually by changing the interaction and/or the spatial correlation between the sliver and the inside wall. In this way, the sliver guidance and the sliver quality can be improved considerably and a substantial increase in the sliver running speed above 1000 m/min can be achieved. These speeds are particularly suitable for draw frames. The improved sliver guidance according to the invention in the same way permits an increase in the sliver quality, even for sliver running speeds below 1000 m/min. These speeds are particularly suitable for carding machines. In particular, the sliver draft is noticeably more uniform in its various sections or regions. The partial drafts and their effects on the sections or regions of the sliver in the sliver channel are more uniform and the tensioning draft is improved on the whole.

Other embodiments of the invention provide a sliver control device for sliver coil depositing. The device includes a coiler plate having a rotational axis, and a spatially curved sliver channel having a wall, an inside wall surface, a sliver inlet and a sliver outlet. The sliver inlet is arranged substantially coaxial with the rotational axis, and the sliver outlet is arranged at a radial distance and an axial distance from the sliver inlet. A drive control is provided for coordinating a tensioning draft upstream from the sliver channel and a movement of a sliver can downstream from the sliver channel such that the sliver is positioned away from at least a portion of the sliver channel inside wall surface.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
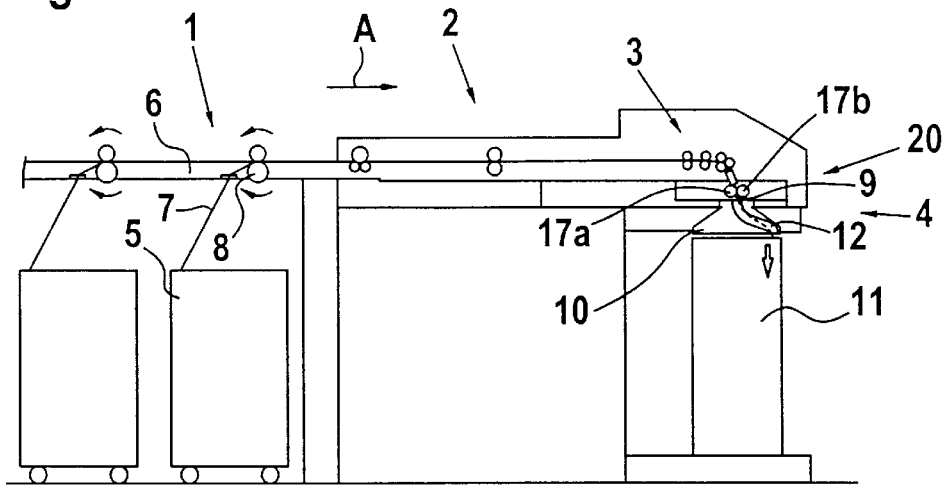
FIG. 1 is a schematic side elevation view of a draw frame with a coiler plate according to the invention.

FIG. 1 shows (partially) the inlet region 1, the measuring region 2, the draw unit 3 and the sliver coil deposit 4 of a draw frame, e.g. a Trützschler Draw Frame Model HSR. In this example, the coiling cans 5 (round cans) of a draw frame are arranged in two can rows in the inlet region 1 beneath the sliver run-in 6 (creel). The feed slivers 7 are pulled off via feed rollers 8 and are supplied to the draw unit 3. After moving through the draw unit 3, the drawn sliver enters a coiler plate 10 of a sliver coil can arrangement 20 and is deposited in the form of rings in an outlet can 11. The coiler plate 10 contains a sliver channel 12, e.g. a curved tube, through which the sliver 9 passes. The arrow A denotes the operating direction of the draw frame while 17*a* and 17*b* represent calender rollers.

Figure 2:
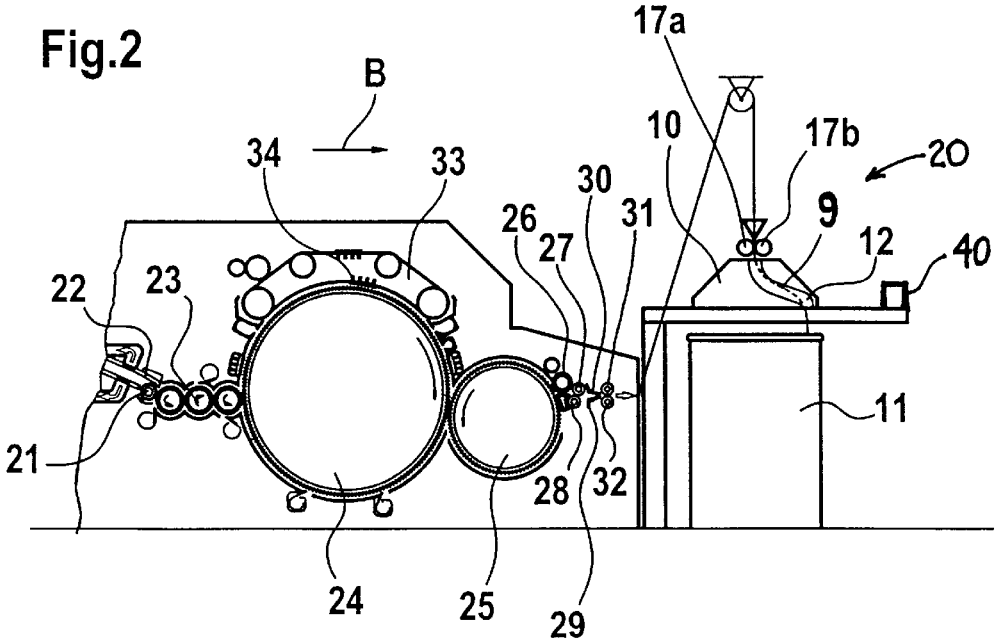
FIG. 2 is a schematic side elevation view of a carding machine with a coiler plate according to the invention.

FIG. 2 shows a carding machine, e.g. a Trützschler High Performance Carding Machine Model DK 903, having a feed roller 21, feed table 22, licker-ins 23, main carding cylinder 24, doffer 25, stripping roll 26, crushing rolls 27, 28, web-guiding element 29, web trumpet 30, withdrawing rollers 31, 32, travelling flats 33 with flat bars 34, withdrawing rollers 17*a*, 17*b*, can 11 and the sliver coil can arrangement 20. Curved arrows are used to show the direction of rotation for the rollers. The card operating direction is shown by the arrow B. A housing containing a rotating coiler plate 10 is located above the cover plate for the sliver coil can arrangement 20. A drive mechanism (not shown) moves the can 11 while the coiler plate 10 deposits the sliver 9 in the can. The coiler plate 10 contains a sliver channel 12, e.g. a curved tube, through which the sliver 9 passes.

Figure 3A:
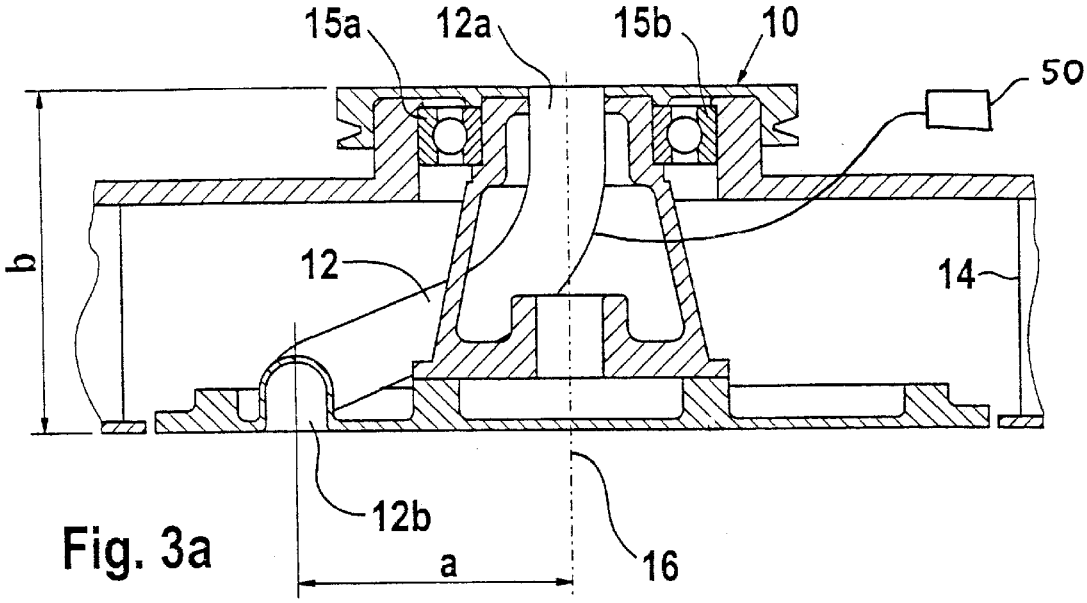
FIG. 3*a* is a sectional view of the coiler plate as shown in FIG. 1.
Figure 3B:
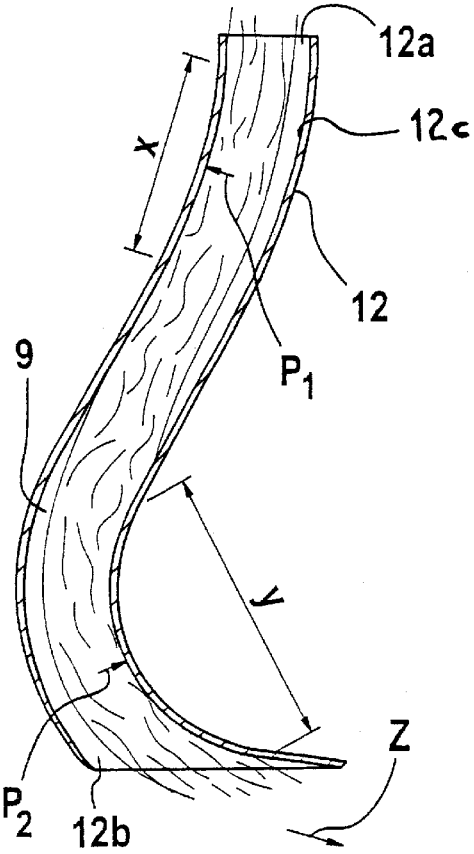
FIG. 3*b* is a sectional view from the side of the sliver channel and sliver.

In the example shown in FIG. 3*a*, the sliver channel 12, for example formed by a bent tube, is spatially curved and is provided with an inlet 12*a* and an outlet 12*b* for the sliver 9 (see FIG. 3*b*). In this example, the inlet 12*a* is arranged coaxial to the rotational axis 16 and the outlet 12*b* is arranged at a radial distance a, as well as an axial distance b, from the inlet 12*a*. The coiler plate 10 is arranged in an opening of the locally fixed plate 14. The sliver outlet opening 12*b*, which is located in the coiler plate 10, can have an elliptical shape. The sliver 9 moves through the sliver channel 12 and exits through the sliver outlet opening 12*b* into the can 11 (see FIG. 1). The reference numbers 15*a*, 15*b* refer to ball bearings.

Inside the sliver channel 12, the sliver 9 is subjected to a slight tensioning draft, designated as tensioning force Z shown in FIG. 3*b*. While passing through, the sliver 9 follows the bends in the sliver channel 12. As a result of these bends and the tensioning force Z, the sliver 9 exerts frictional forces $P_1$ and $P_2$ in the regions x and y onto the inside wall 12*c* of the sliver channel. Frictional forces $P_1$ and $P_2$ are larger than frictional forces present in the remaining areas of the inside wall 12*c*. A relative movement exists between the running sliver and the inside wall 12*c*.

Figure 3C:
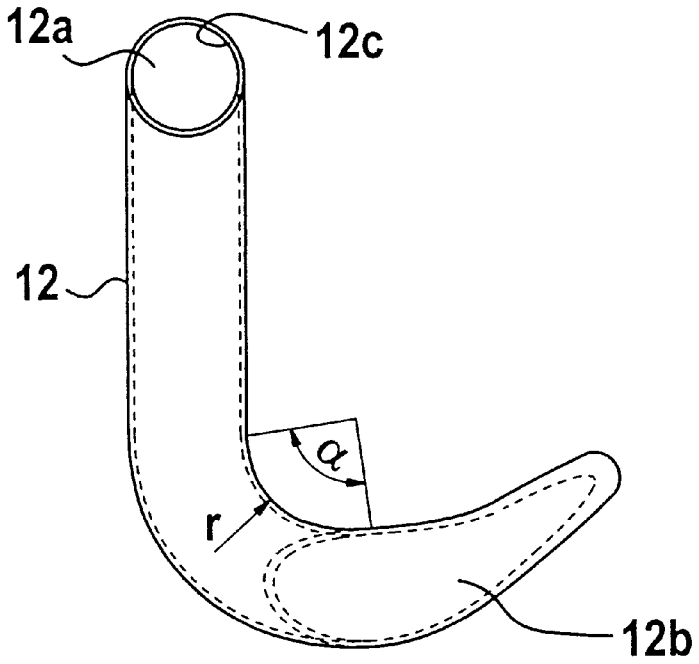
FIG. 3*c* is a top plan view of the sliver channel.

According to the invention, the frictional resistance between sliver 9 and inside wall 12*c* is reduced by changing the interaction and/or the spatial coordination between sliver 9 and inside wall 12*c* of the sliver channel 12. The regions x and y of the inside wall 12*c* in this case are of considerable importance. The friction between sliver 9 and the regions x and y on the inside wall 12*c* can thus be reduced by reducing the friction coefficient $\mu$, by reducing the friction angle $\alpha$ and/or by increasing the curvature radius r (see FIG. 3*c*). The tensioning force Z that is determined by the withdrawing rollers 17*a*, 17*b* and the speed of can 11 can also be changed. These measures, either individually or in combination, can reduce the frictional forces $P_1$ and $P_2$.

The coiler plate 10 deposits the outlet sliver 9 arriving from the sliver-forming machine in a cycloidal manner in the spinning can 11. The cycloidal shape is created by superimposing two rotational movements, a fast movement realized by the coiler plate 10 and a slow movement realized by the can 11 (in the case of the rectangular can, the second (slow) movement is a translational movement). During the deposit, the sliver is subjected to various forces inside the channel 12, such as the force of gravity, centrifugal force, the pre-tensioning force caused by the effective tensioning draft, the frictional force between sliver 9 and the channel inside wall 12*c*. The frictional force is counter to the movement direction of the sliver 9 and thus hinders the discharge operation. To obtain clean operating conditions, the tensioning draft is controlled such that the sliver channel 12 is always subjected to some tension. The sliver thus always fits itself against the convex curved, smaller inside radius of the curved areas in all curved regions of the channel 12. The above-mentioned frictional force essentially is generated by the interaction between sliver 9 and channel 12 in the contact zones x and y. The previously described negative influences on the machine behavior and the sliver quality are primarily determined by this friction between sliver 9 and inside wall 12c of the channel 12.

The following measures are implemented either individually or in combination to improve the sliver guidance in the channel 12.

Lowering the amount of friction between the sliver material and the inside surface of the channel can be achieved by coating the channel in sections or producing it with low-friction materials. The tensioning draft can be lowered in this way and the number of undesirable drafts can be reduced.

The geometry of the channel can be changed so that the sliver material is prevented from unwinding across the circumference of the channel 12.

The channel 12 can be expanded, in particular in the inlet area 12*a*. As a result, the contact between channel 12 and the sliver 9 is minimized under the influence of the tensioning.

Forces can be exerted from the outside onto the sliver 9 by a field generator 50 that generates a magnetic or electric field in order to reduce the friction between the sliver and the channel surface 12*c*.

Fluctuations in the sliver stress caused by the sliver depositing can be compensated for with the aid of a drive controller 40 of, e.g. the can 11 (see FIG. 2). By coordinating the tensioning draft and the can rotational speed, the sliver stress (and the resulting sliver path) can be controlled, resulting in less friction between the sliver and the sliver channel.

A suitable design for the sliver channel can reduce the length over which the sliver is guided.

The sliver channel 12 can have a shape other than round (for example elliptical).

The measures for reducing the friction inside the sliver channel can be used, for example, for draw frames, carding machines and roller card units.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A sliver control device comprising:

a coiler plate for depositing a sliver subjected to a tension draft in a sliver coil, the coiler plate having a rotational axis and comprising:

a spatially curved sliver channel having a wall, an inside wall surface, a sliver inlet and a sliver outlet, the sliver inlet being arranged substantially coaxial with the rotational axis, and the sliver outlet being arranged at a radial distance and an axial distance from the sliver inlet; and a friction reducer, the friction reducer having a drive control for coordinating a tensioning draft upstream from the sliver channel and a movement of a sliver can downstream from the sliver channel such that the sliver is positioned away from at least a portion of the sliver channel inside wall surface, wherein a relative movement exists between the sliver and the inside wall surface of the sliver channel, and the friction reducer facilitates the relative movement by eliminating at least a portion of a frictional resistance acting on the sliver through the inside wall surface.

2. The device according to claim 1, wherein a portion of the sliver channel inside wall surface is convex toward a sliver running path, and the portion of the frictional resistance is eliminated by the friction reducer at the convex portion of the sliver channel inside wall surface.

3. The device according to claim 1, wherein a section of the inside wall surface comprises a low friction material.

4. The device according to claim 3, wherein the low friction material comprises a coating.

5. The device according to claim 4, wherein the entire inside wall surface comprises a low friction material.

6. The device according to claim 1, wherein the spatial curve of the sliver channel approximates a curve defined by an unconstrained sliver spun about its central axis.

7. The device according to claim 1, wherein the sliver inlet has a cross sectional area greater than a cross sectional area of a central portion of the sliver channel.

8. The device according to claim 1, wherein a portion of the sliver channel is circular in cross section.

9. The device according to claim 1, wherein a portion of the sliver channel is elliptical in cross section.

10. The device according to claim 1, wherein a portion of the sliver channel is polygonal in cross section.

11. The device according to claim 1, wherein the sliver outlet has an elliptical cross section.

12. A carding machine comprising the device according to claim 1.

13. A draw frame comprising the device according to claim 1.

14. The device according to claim 1, further comprising a field producer that produces a field, the field being at least one of a magnetic field and an electric field, wherein the field is for acting on the sliver such that the sliver is positioned away from at least a portion of the sliver channel inside wall surface.

* * * * *